US005145088A

United States Patent [19]

Goujon

[11] Patent Number: 5,145,088

[45] Date of Patent: Sep. 8, 1992

[54] PLASTIC COVER FOR CONTAINER

[75] Inventor: Daniel Goujon, Chemin du Sécheron, 01460 Brion, France

[73] Assignees: Plastiques RG; Daniel Goujon, both of France

[21] Appl. No.: 743,765

[22] Filed: Aug. 12, 1991

[51] Int. Cl.[5] ..... B65D 43/06; B65D 43/16

[52] U.S. Cl. ..... 220/355; 220/335; 220/337; 220/254; 220/259; 220/276

[58] Field of Search ..... 220/254, 265, 268, 269, 220/276, 334, 335, 337, 339, 355, 356, 640, 642, 643, 259, 266

[56] References Cited

U.S. PATENT DOCUMENTS

| | | | |
|---|---|---|---|
| 685,900 | 11/1901 | Anderson | 220/269 X |
| 1,968,943 | 8/1934 | Hermani | 220/269 |
| 3,442,414 | 5/1969 | Pelli | 220/339 X |
| 3,812,993 | 5/1974 | Yoshioka et al. | 220/269 X |
| 3,831,798 | 8/1974 | Rowe et al. | 215/256 |
| 4,113,136 | 9/1978 | Abbott | 220/276 |
| 4,431,114 | 2/1984 | Kleinfeld | 220/337 |
| 4,465,205 | 8/1984 | Sutch | 220/276 |
| 4,649,813 | 3/1987 | Kehl | 220/337 X |
| 4,883,193 | 11/1989 | Christensson | 220/266 |
| 4,905,861 | 3/1990 | Boxall et al. | 220/266 |
| 4,932,549 | 6/1990 | Gouttefangeas | 220/254 |
| 4,934,557 | 6/1990 | Smith | 220/276 |
| 5,002,197 | 3/1991 | Ponsi | 220/254 |
| 5,012,928 | 5/1991 | Proffitt et al. | 220/259 X |
| 5,050,763 | 9/1991 | Christensson | 220/355 |
| 5,085,339 | 2/1992 | Roth et al. | 220/269 |

FOREIGN PATENT DOCUMENTS

| | | |
|---|---|---|
| 2496056 | 6/1982 | France . |
| 1257094 | 12/1971 | United Kingdom . |

*Primary Examiner*—Stephen Marcus
*Assistant Examiner*—Vanessa Caretto
*Attorney, Agent, or Firm*—Parkhurst, Wendel & Rossi

[57] ABSTRACT

A plastic cover for a container including a central cover plate having a peripheral flange in a U-shaped cross-section having outer and inner arms connected by a joining portion, the inner arm being integral with the central cover plate, the peripheral flange adapted to snap onto a complementary rim of the mouth of a container, the joining portion of the peripheral flange including a slot around substantially the entire periphery of the cover and defining two opposite lips; a plurality of integral tab-spots spaced around the length of the slit and connecting the two lips; a gripping tab integral with the inner arm; and hinge segments integral with the two lips at locations on the cover substantially opposite the gripping tab.

5 Claims, 2 Drawing Sheets

PLASTIC COVER FOR CONTAINER

BACKGROUND OF THE INVENTION

The present invention relates to an improved plastic container or dish cover.

It is well known to make plastic containers or dishes closed by a cover and intended to hold any of a variety of foodstuffs, such as butter. Presently, such covers typically consist of a central plate and a peripheral flange defining a U-shaped cross-section having two arms, namely an outer and inner arm, each of which are joined by a joining segment, the inner arm in turn being joined to the central plate. The periphery of the cover snaps onto a matching rim of a container or dish. Even though in widespread use, this design has the drawback that the cover will sometimes be difficult to remove from the container. Removal of the cover will be even more difficult when the container is cold, for instance after having been refrigerated in a refrigerator.

The present invention overcomes those drawbacks. It is an object of the present invention to provide a container cover which is easily manufactured, does not require extensive modification of existing molding equipment, will accept labels as may be required, and will not exhibit difficulties in opening as discussed above.

BRIEF SUMMARY OF THE INVENTION

The plastic container cover of the present invention comprises a central plate, a peripheral flange having a U-shaped cross-section having inner and outer arms joined by a joining segment, with the inner arm in turn integral with the central plate, and a peripheral flange formed to be complementary with the rim of the mouth of a container upon which the cover may be used. This inventive cover is particularly characterized in that the joining segment at the junction of the two arms of the U-shaped cross-sectioned flange includes a slit which extends around substantially the entire periphery of the flange thereby defining two mutually opposite lips, and associated with this slit are a plurality of narrow spots or tab portions around the cover which connect the two lips. On one side of the cover is a gripping tab which is integral with the lip connected to the inner arm of the U-shaped cross section, and thus connected to the central plate, and on the side opposite the lip having the gripping tab are hinge segments connecting the two lips thereby forming a hinge.

Other practical aspects of the inventive container cover structure include an embodiment wherein the lip integral with the outer arm of the U-shaped cross section includes a recess opposite the gripping tab so that the gripping tab is more easily accessible, and the lips between the two segments which act as a hinge include an integrally molded stop member to keep the cover in its open position when desired.

BRIEF DESCRIPTION OF THE DRAWINGS

Further features and advantages of preferred embodiments of the present invention are described in conjunction with the accompanying drawings, wherein.

DETAILED DESCRIPTION

Figure 1:
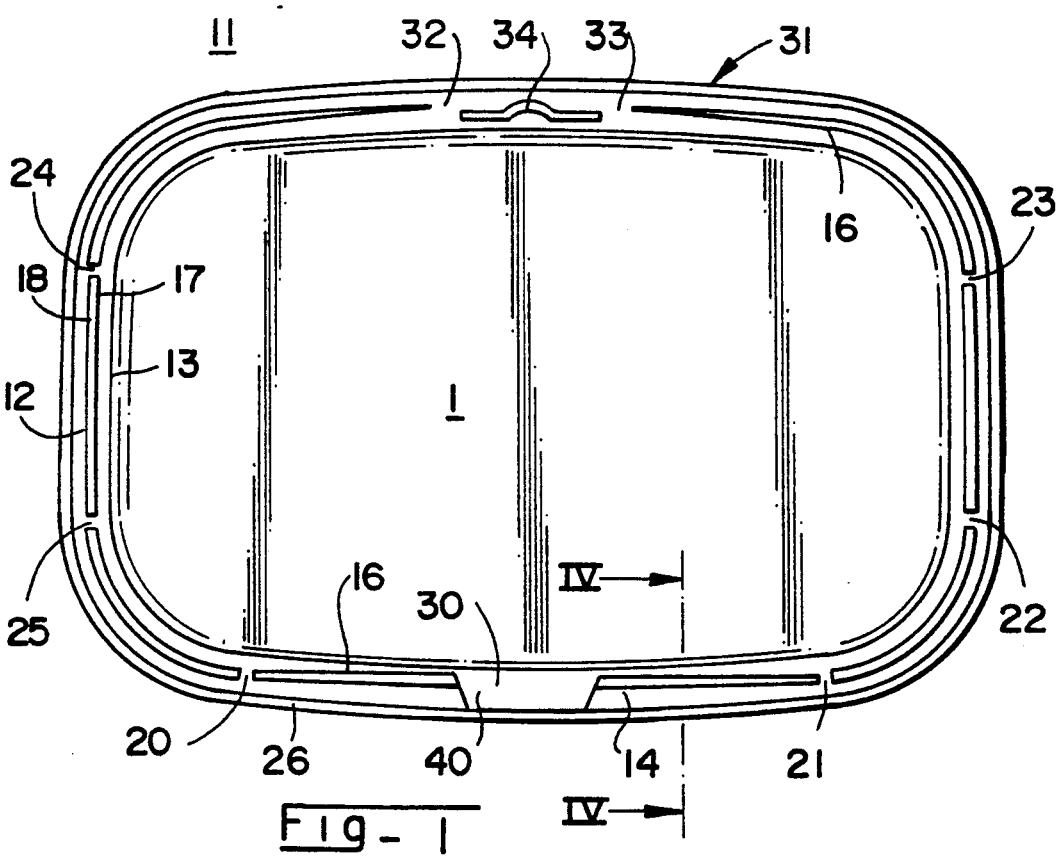
FIG. 1 is a top view of the closed container cover of the present invention.
Figure 2:
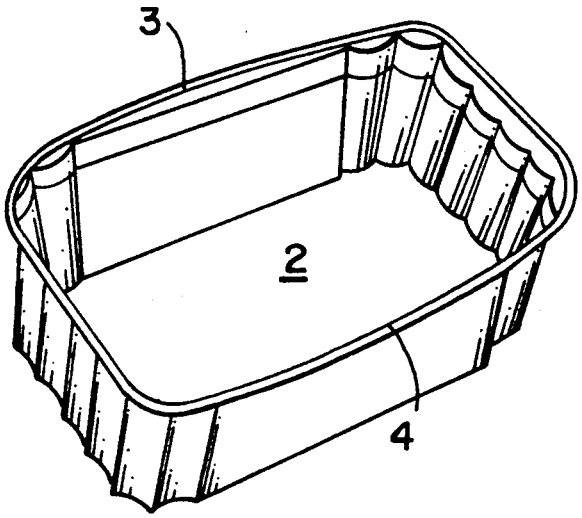
FIG. 2 is an isometric view of a container or dish suited for use in conjunction with the inventive cover.

The container or dish cover of the present invention identified with the numeral 1 in the Figures is intended to be snapped onto a container or dish such as that designated by the numeral 2 in FIG. 2, which dish comprises a rim 3 with lip 4 extending outwardly and onto which the cover 1 may be snapped. The cover 1 and the container or dish 2 may be made in a known manner, namely molding, from a suitable plastic material which may be selected in view of the intended final application of the container/cover combination, which material may, for example, be polypropylene or high density polyethylene.

Figure 4:
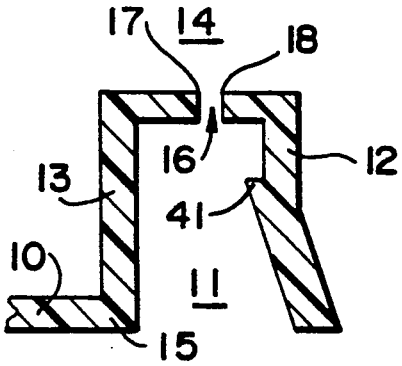
FIG. 4 is a partially schematic cross-sectional view along line IV—IV of FIG. 1.

The cover comprises a central plate 10 which may receive an appropriate label, and a peripheral flange 11 having a U-shaped cross-section which includes two arms, an outer arm 12 and an inner arm 13, which are joined by a joining portion generally designated 14, as perhaps best illustrated in FIG. 4. Inner arm 13 also joins or is integral with central plate 10 at junction 15. In the present invention, joining portion 14 of the peripheral flange 11 which comprises arms 12 and 13 of the U-shaped cross section includes a slit 16 in joining portion 14 of flange 11 which slit extends through and substantially around the entire periphery of the flange 11, thereby defining two mutually opposite lips 17 and 18. Slit 16 is interrupted by a plurality of spaced, molded but severable tabs or spots 20–25 which initially link the opposite lips 17 and 18.

The inventive cover may additionally comprise, usually along one of its longer sides, namely peripheral portion or side 26, a gripping tab 30 which is also integrally molded with inner lip 17 and thus linked with inner arm 13 and central plate 10. Advantageously, a clearance or recess 40 may be provided at the level of gripping tab 30 in outer lip 18 to facilitate access to gripping tab 30.

In still another feature of the present invention, peripheral portion or side 31 of the cover opposite peripheral portion or side 26 comprises at least two spaced hinge segments 32 and 33 linking lips 17 and 18 on opposite sides of slit 16 thereby forming a hinge. Preferably, the thickness of the plastic material is less at the location of the hinge segments 32, 33 than elsewhere in the cover structure. This less thick portion facilitates bending of hinge segments 32, 33 so that they more readily act as a flexible hinge. Furthermore, in a preferred embodiment of the hinge, inner lip 17 includes a stop 34 also integrally molded with the cover for engaging the opposite lip to facilitate maintaining the cover in its open position.

In the advantageous embodiment shown in FIG. 4, the inner surface of outer arm 12 includes an offset, ridge or catch 41 which may be annular in the sense that it may extend entirely, partially or completely around the periphery of the cover, and which cooperates with an outer lip 4 of rim 3 of a container or dish 2, as shown in FIG. 2, to assure that the cover is maintained in place on such a container.

It should be clear to those skilled in the art that the cover of the present invention may be manufactured by techniques which are well known present-day molding techniques, without the need for significant modifications of injection molds in order to adapt them to the precise form of the present invention. Additionally, the cover of the present invention is used in a conventional manner and may have appropriate labeling affixed thereto, typically on the outer surface of central plate 10.

Figure 3:
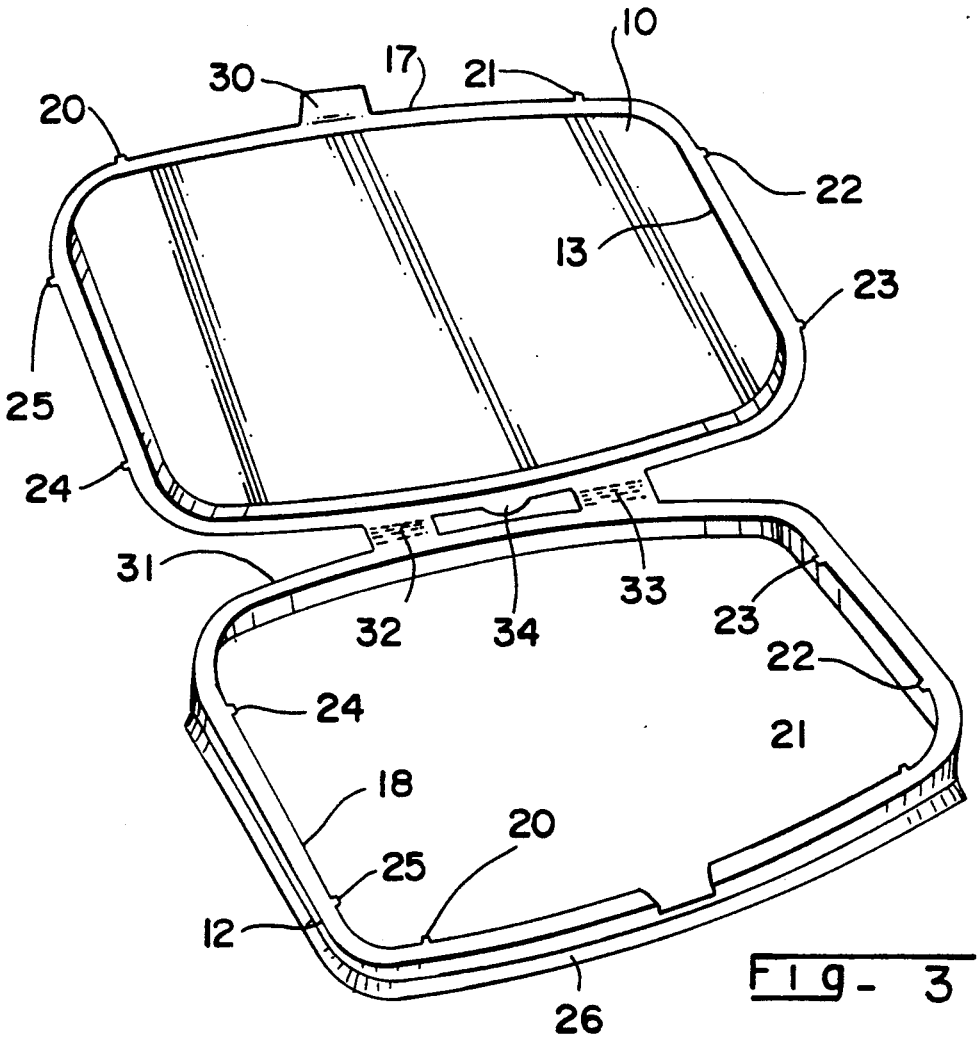
FIG. 3 is an isometric view of the container cover of the present invention in open position.

When the user wishes to open a container or dish having the cover of the present invention thereon, it is adequate to grasp tab 30 and to pull it upwardly, thereby breaking the severable tabs or spots 20–25, whereupon the cover plate 10 pivots about an axis defined by hinge segments 32, 33 into an open position as illustrated in FIG. 3.

Accordingly, access to the contents of a container or dish covered with the cover of the present invention is quite easy, and after the contents of such a container have been removed to the extent desired, the user closes top plate 10 by again rotating it about the axis defined by hinge segments 32, 33 and snapping the inner arm 13 into the rim 3 of the mouth of the container upon which the present invention is mounted, thereby closing the container. This opening/closing operation may be repeated numerous times without difficulty using the advantageous container cover of the present invention.

It thus should be clear that the features of the present invention make access to the contents of a container covered thereby quite easy. Furthermore, the severable tabs or spots 25 provide an integrity feature to the unopened cover which is useful before a container is first opened.

Figure 5:
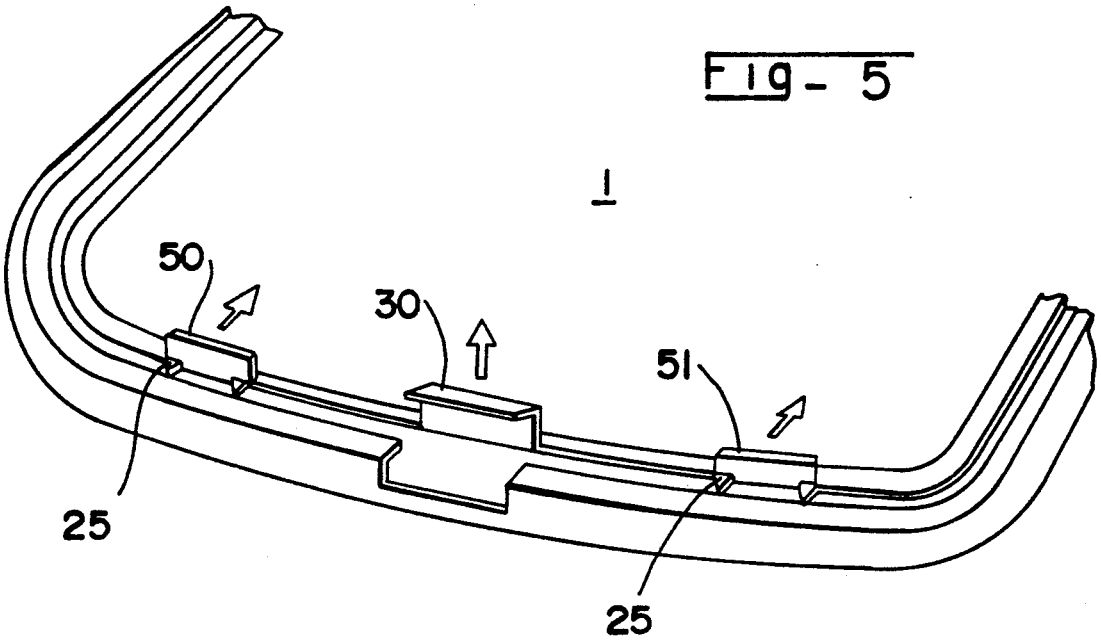
FIG. 5 is a partially schematic isometric view of the leading edge of an improved embodiment of the container cover of the present invention.

In an improved embodiment shown in FIG. 5, opening of the cover is further facilitated by the provision of vertical risers or reinforcements 50, 51 on outer lip 18 near severable tabs or spots 20–25 to serve as thrust supports thereby facilitating rupture of tabs or spots 20–25 when in their initially molded, unruptured condition.

Those skilled in the art will appreciate that the container or dish cover of the present invention offers several advantages over any existing dish covers. The cover of the present invention is easily opened and will readily stay open thanks to the stop 34 near the hinges so that the open cover will not hamper the user. Furthermore, the cover remains attached to a dish and is not lost or soiled during handling and may be quickly and easily closed following each use. The design ensures that following each opening and closing operation, an adequate seal is still achieved for the dish/cover combination, thereby eliminating the need for further wrapping and thereby achieving additional economy and improved sanitation. Still further, the container cover of the present invention may be simply manufactured, both with respect to molding and tool design, thus resulting in low manufacturing cost. And, the cover is easily put in place during initial packaging of products such as foods, in containers, without the need for special tooling or precautions, again resulting in significant economies.

While the container cover of the present invention has been described in conjunction with specific embodiments and features, those skilled in the art will appreciate that other modifications and features may be used as a part of the inventive container cover, which modifications may still be within the scope and spirit of the appended claims.

What is claimed is:

1. A cover for a container, comprising:

a central cover plate;

a peripheral flange disposed substantially at a periphery of said cover, said peripheral flange having a generally U-shaped cross-section at least partially defined by inner and outer arms connected by a joining portion, said inner arm being integral with said central cover plate, said peripheral flange being adapted to snap onto a complimentary rim of a mouth of a container;

inner and outer lip integrally formed with said inner and outer arms, respectively, thereby defining a peripheral slot extending substantially completely around said periphery of said cover;

a plurality of severable tab-spots disposed within said peripheral slot thereby connecting said inner and outer lips;

a gripping tab integral with said inner arm in at least one region of said periphery of said cover; and at least two hinge segments joining said inner and outer lips substantially within said peripheral slot, said at least two hinge segments being disposed substantially diametrically opposite said gripping tab to permit rotation of said central cover plate about a rotation axis defined by said hinge segments.

2. The cover of claim 1, wherein the outer lip includes a recess opposite the gripping tab on the inner lip, for facilitating access to the gripping tab.

3. The cover of claim 1, additionally comprising a stop member integral with one of said inner and outer lips and located between two of said at least two hinge segments, for engaging the other of said one of said inner and outer lips to maintain the cover in open position.

4. The cover of claim 1, wherein the periphery of said cover is substantially rectangular for covering a substantially rectangular mouth of a container.

5. The cover of claim 1, additionally comprising an integral reinforcing portion on the outer lip adjacent at least one of the tabs-spots for facilitating rupture of the tab-spot.

* * * * *